US008287160B2

(12) United States Patent
Shen

(10) Patent No.: US 8,287,160 B2
(45) Date of Patent: Oct. 16, 2012

(54) LED LIGHT ASSEMBLY

(76) Inventor: Min-Dy Shen, Taipei (TW)

( * ) Notice: Subject to any disclaimer, the term of this patent is extended or adjusted under 35 U.S.C. 154(b) by 428 days.

(21) Appl. No.: 12/763,765

(22) Filed: Apr. 20, 2010

(65) Prior Publication Data

US 2011/0255292 A1 Oct. 20, 2011

(51) Int. Cl.
*F21V 3/04* (2006.01)

(52) U.S. Cl. ..... 362/375; 362/311.02

(58) Field of Classification Search ..... None
See application file for complete search history.

(56) References Cited

U.S. PATENT DOCUMENTS

| | | | | |
|---|---|---|---|---|
| 8,026,529 | B2 * | 9/2011 | Huang | 257/98 |
| 2005/0286252 | A1 * | 12/2005 | Hanano | 362/332 |
| 2009/0153973 | A1 * | 6/2009 | Tsai | 359/614 |
| 2011/0267823 | A1 * | 11/2011 | Angelini et al. | 362/277 |

* cited by examiner

*Primary Examiner* — Tracie Y Green
(74) *Attorney, Agent, or Firm* — Chun-Ming Shih

(57) ABSTRACT

An LED light assembly includes a main body, at least one flexible strip, an LED module, a light diverging unit and a top cover. The flexible strips are fitted to the bottom of the main body. A circular slot is provided near the upper rim of the main body. In assembly, first the LED module is fitted to the circular slot. Then, the light diverging unit is fitted to the LED module. Last, connect the top cover with the main body. The movement of the light diverging unit may be limited.

5 Claims, 8 Drawing Sheets

LED LIGHT ASSEMBLY

BACKGROUND OF THE INVENTION

1. Field of the Invention

The invention generally relates to an LED light assembly. More particularly, the invention relates to an LED light assembly that is used for illumination and may be installed quickly.

2. Description of the Prior Art

Lights have been widely used in our daily life. They allow us to read at night and provide indoor lighting.

Most of the lamps in the prior art use incandescent bulbs, mercury lights, sodium lights, fluorescent lights, etc. However, they only have a single way of illumination.

The LED light assembly of the present invention can provide illumination in a converging manner or a diverging manner. In addition, because LED is used, the brightness is enhanced.

Therefore, improvements are needed for the lamps in the prior art.

To eliminate the disadvantage in the prior art, the inventor has put a lot of effort into the subject and has successfully come up with the LED light assembly of the present invention.

SUMMARY OF THE INVENTION

An object of the present invention is to provide an LED light assembly that can provide light in a diverging manner to distribute the light evenly.

Another object of the present invention is to provide an LED light assembly is structurally simple and easy to use and may be installed quickly.

To reach these objects, the LED light assembly of the present invention is disclosed. The LED light assembly of the present invention comprises a main body, at least one flexible strip, an LED module, a light diverging unit and a top cover. The flexible strips are fitted to the bottom of the main body. A guiding portion that extends upwards is provided on either side of each flexible strip. A male thread is provided on the outer surface of the main body and a circular slot is provided near the upper rim of the main body. Two holes are provided in the circular slot. In assembly, first fasteners may be used to fixedly connect the LED module with the main body. Then, the light diverging unit is fitted to the LED module. Last, connect the top cover with the main body through the engagement of a female thread of the top cover and the male thread of the main body. A circular protrusion, which extends from the rim of the opening, can limit the movement of the light diverging unit. The LED light assembly of the present invention is formed with these components.

These features and advantages of the present invention will be fully understood and appreciated from the following detailed description of the accompanying Drawings.

DETAILED DESCRIPTION OF THE PREFERRED EMBODIMENT

Figure 1:
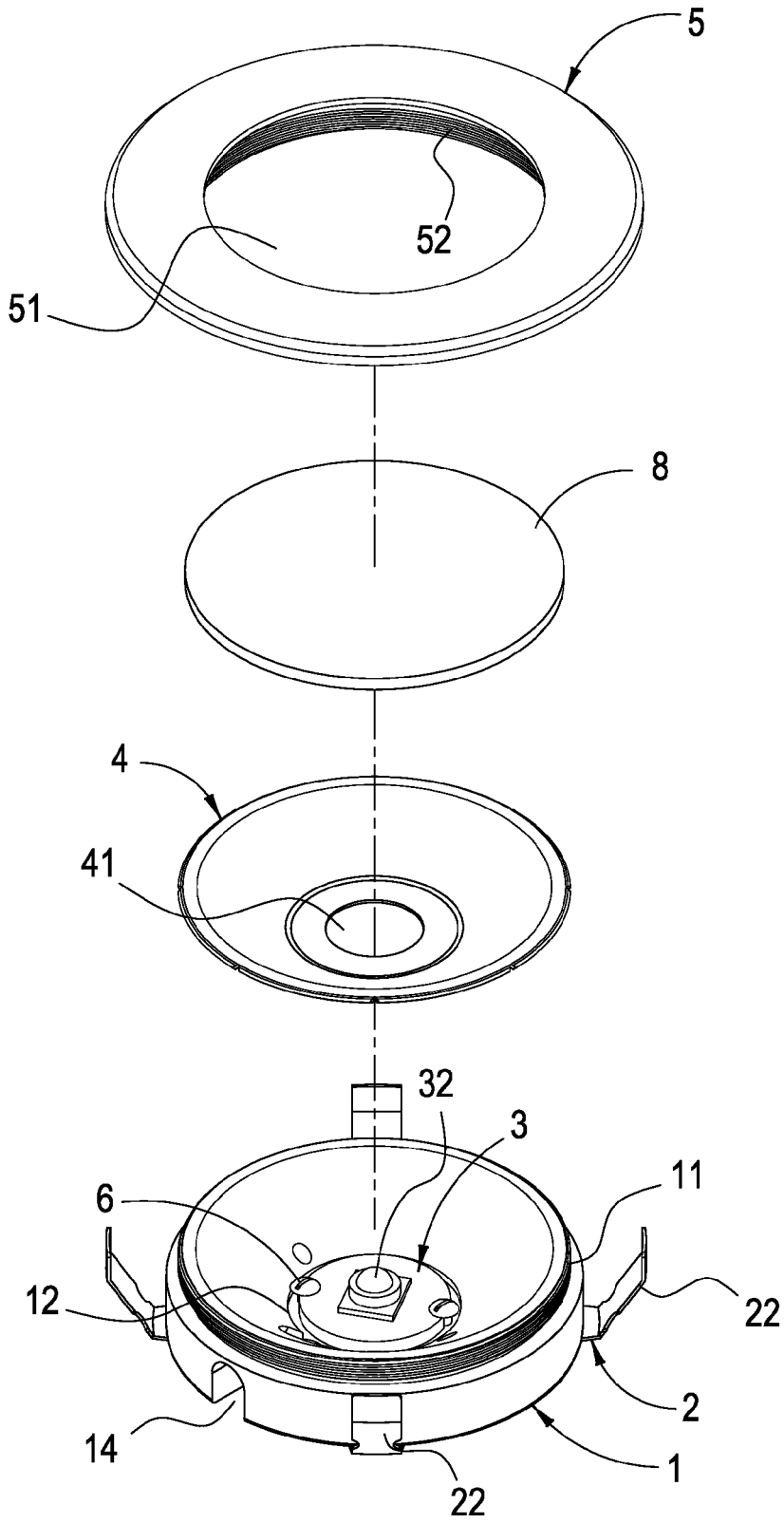
FIG. 1 is an exploded view showing the first embodiment of the present invention.
Figure 2:
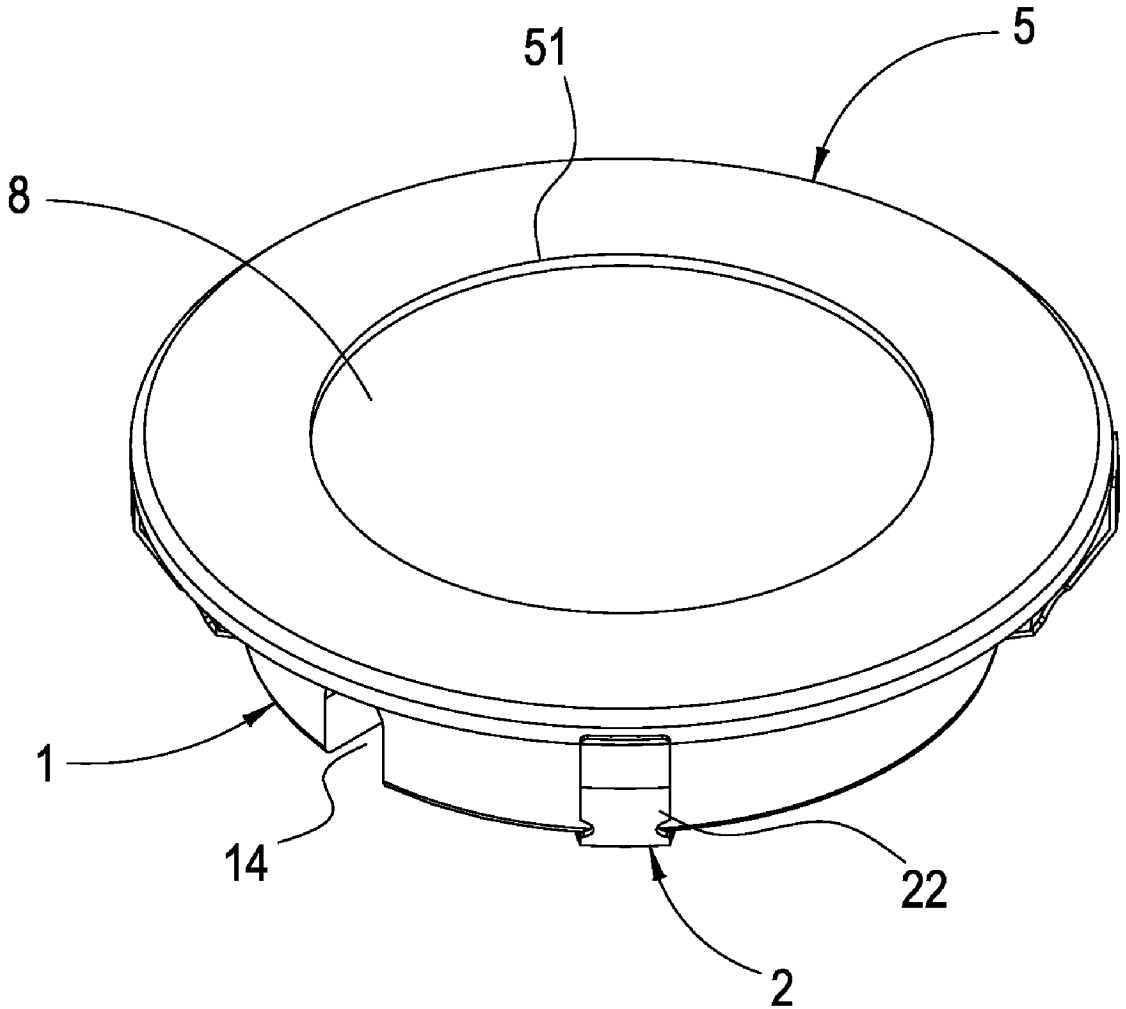
FIG. 2 is another view showing the first embodiment of the present invention in an assembled condition.
Figure 3:
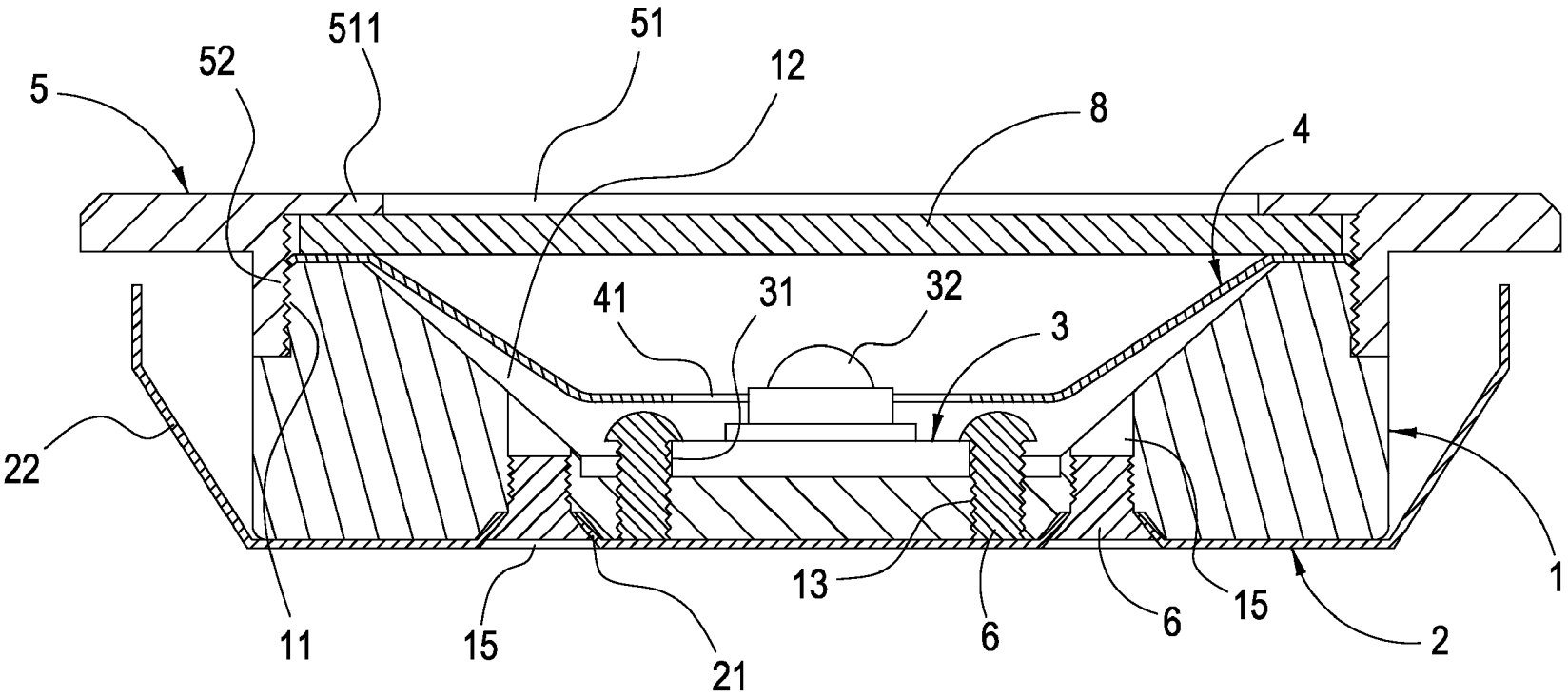
FIG. 3 is a sectional view showing the first embodiment of the present invention.

Please see FIGS. 1, 2 and 3, which are three views illustrating the first embodiment of the present invention. The LED light assembly of the present invention comprises a main body 1, at least one flexible strip 2, an LED module 3, a light diverging unit 4, a light transmitting piece 8 and a top cover 5.

A male thread 11 is provided on the outer surface of the main body 1 and a circular slot 12 is provided near the upper rim of the main body 1. Two holes 13 are provided in the circular slot 12. An electric line slot 14 and at least a positioning hole 15 are provided in the bottom of the main body 1. The main body 1 may be made of metal.

Two positioning holes 21 are disposed on each flexible strip 2 and may be aligned with the positioning holes 15 of the main body 1. A guiding portion 22 that extends upwards is provided on either side of each flexible strip 2. The flexible strips 2 are fitted to the bottom of the main body 1. In assembly, first the two positioning holes 21 of each flexible strip 2 are lined up with the positioning holes 15 of the main body 1 and then fasteners 6 are used to fixedly connect them together. The flexible strips 2 may be made of metal. The fasteners 6 may be screws.

A slot 31 is provided on either side of the LED module 3. The two slots 31 may be lined up with the two holes 13 of the main body 1. A light emitting element 32 is disposed on the LED module 3. In assembly, the LED module 3 is fitted to the slot 12 of the main body 1. Also, first the two slots 31 are lined up with the two holes 13 of the main body 1 and fasteners 6 are used to fixedly connect them together. The light emitting element 32 may be an LED.

An opening 41 is provided on the lower end of the light diverging unit 4 and may be lined up with the light emitting element 32. The light diverging unit 4 is fitted on top of the light emitting element 32.

The light transmitting piece 8 is disposed on top of the light diverging unit 4.

A through opening 51 is provided in the top cover 5. A circular protrusion 511, which extends from the rim of the opening 51, is provided. A female thread 52 is provided near the through opening 51 of the top cover 5 and may fixedly engage with the male thread 11 of the main body 1. The top cover 5 may be made of metal.

The aforementioned components may be fitted together to form the LED light assembly of the present invention.

The components of the assembly of the present invention may be made of aluminum or other types of metals that can dissipate and absorb heat quickly. Because almost all the components of the assembly of the present invention are made of metal, heat generated by the LED module 3 may be dissipated quickly and hence the assembly of the present invention may have a longer service life.

Figure 4:
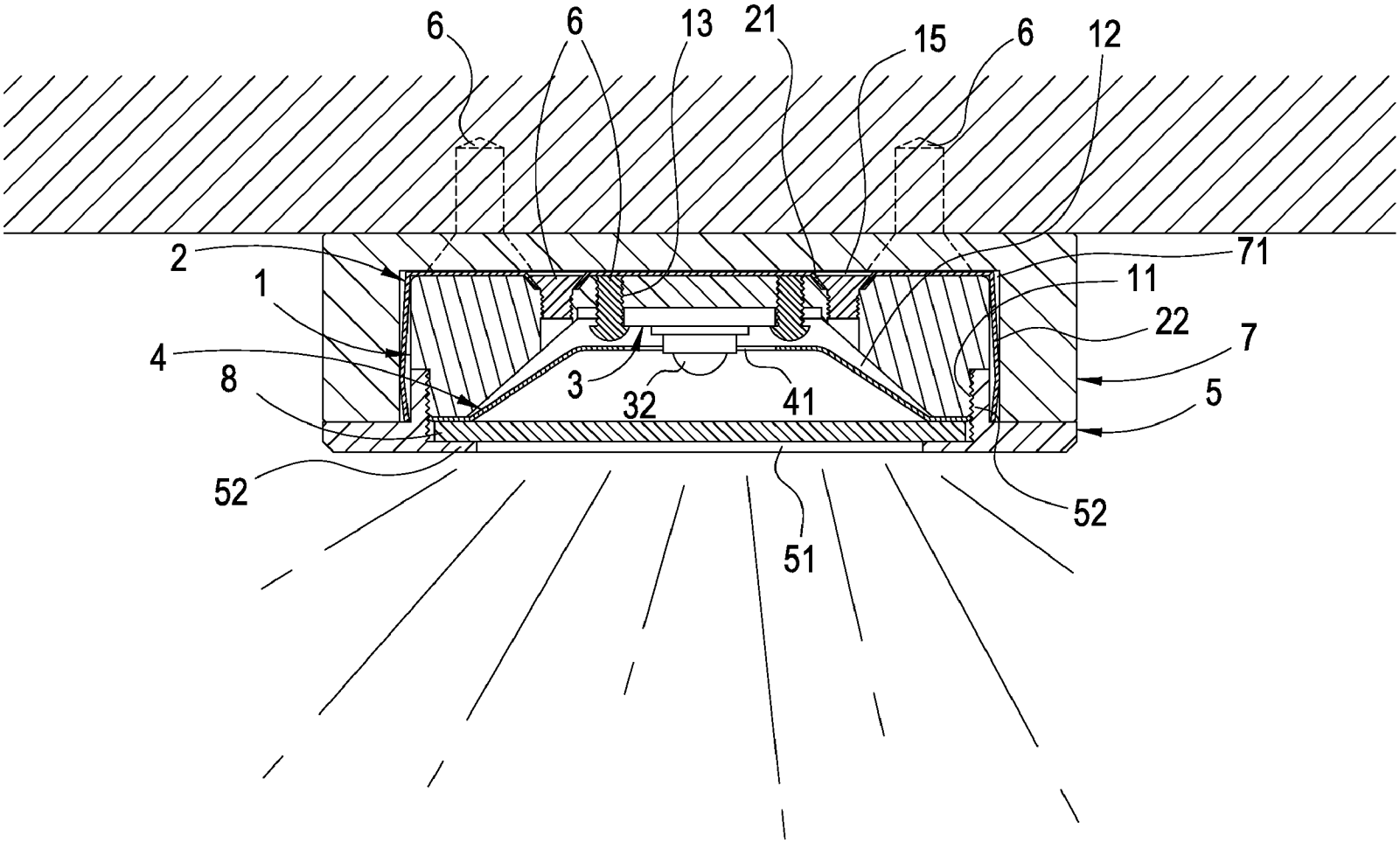
FIG. 4 is a view showing the first embodiment of the present invention in installation.
Figure 6:
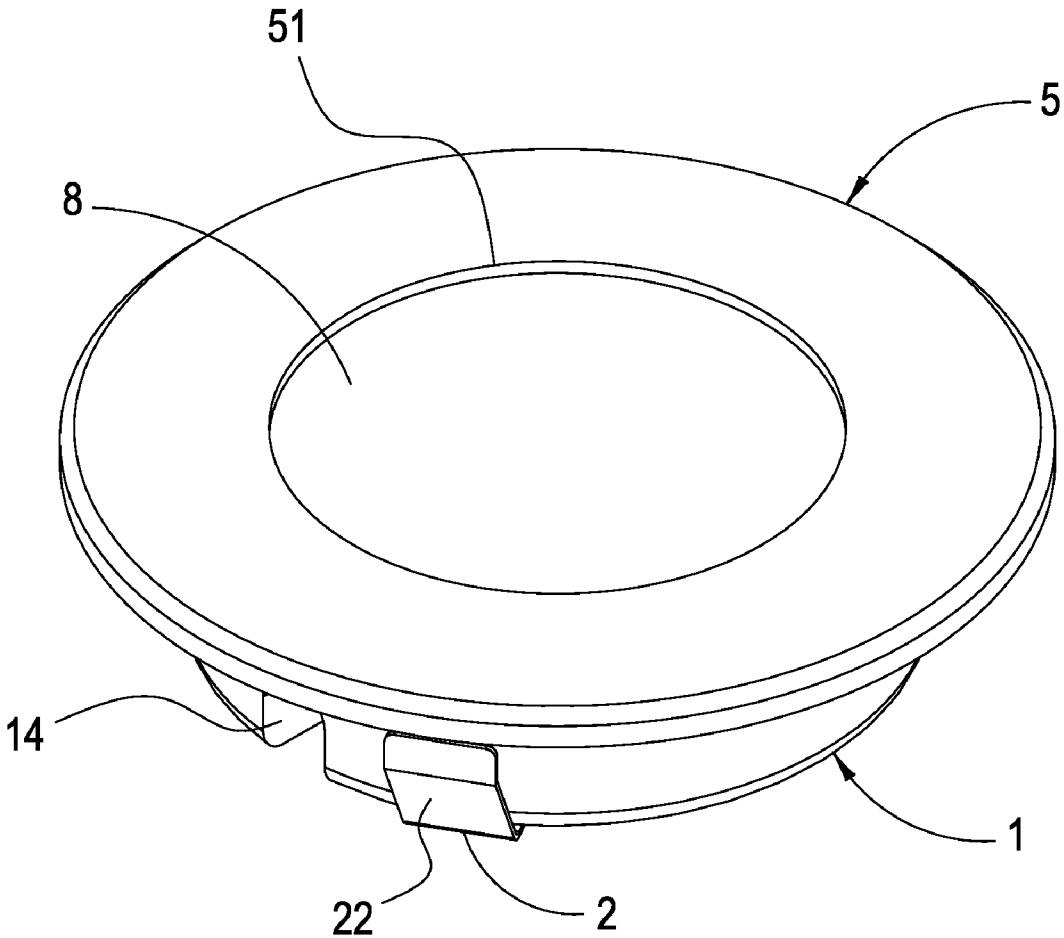
FIG. 6 is another view showing the second embodiment of the present invention in installation.

Please see FIG. 4. In installation, the two guiding portions 22 of the flexible strips 2 can guide the assembly of the present invention into a recess 71 of a seating unit 7. As we push the flexible strips 2 into the recess 71, the two guiding portions 22 would press against the inner walls of the recess 71 (as shown in FIG. 6). Now, the assembly of the present invention may be fixed held in the recess 71. Because the light diverging unit 4 is used, light may be distributed evenly. Therefore, with regard to the assembly of the present invention, installation and uninstallation may be done quickly and thus the assembly of the present invention is quite valuable in application.

In addition, fasteners 6 are used to fixedly connect seating unit 7 of the present invention with a wall or cabinet. By this manner, the components may be installed in many locations.

Figure 5:
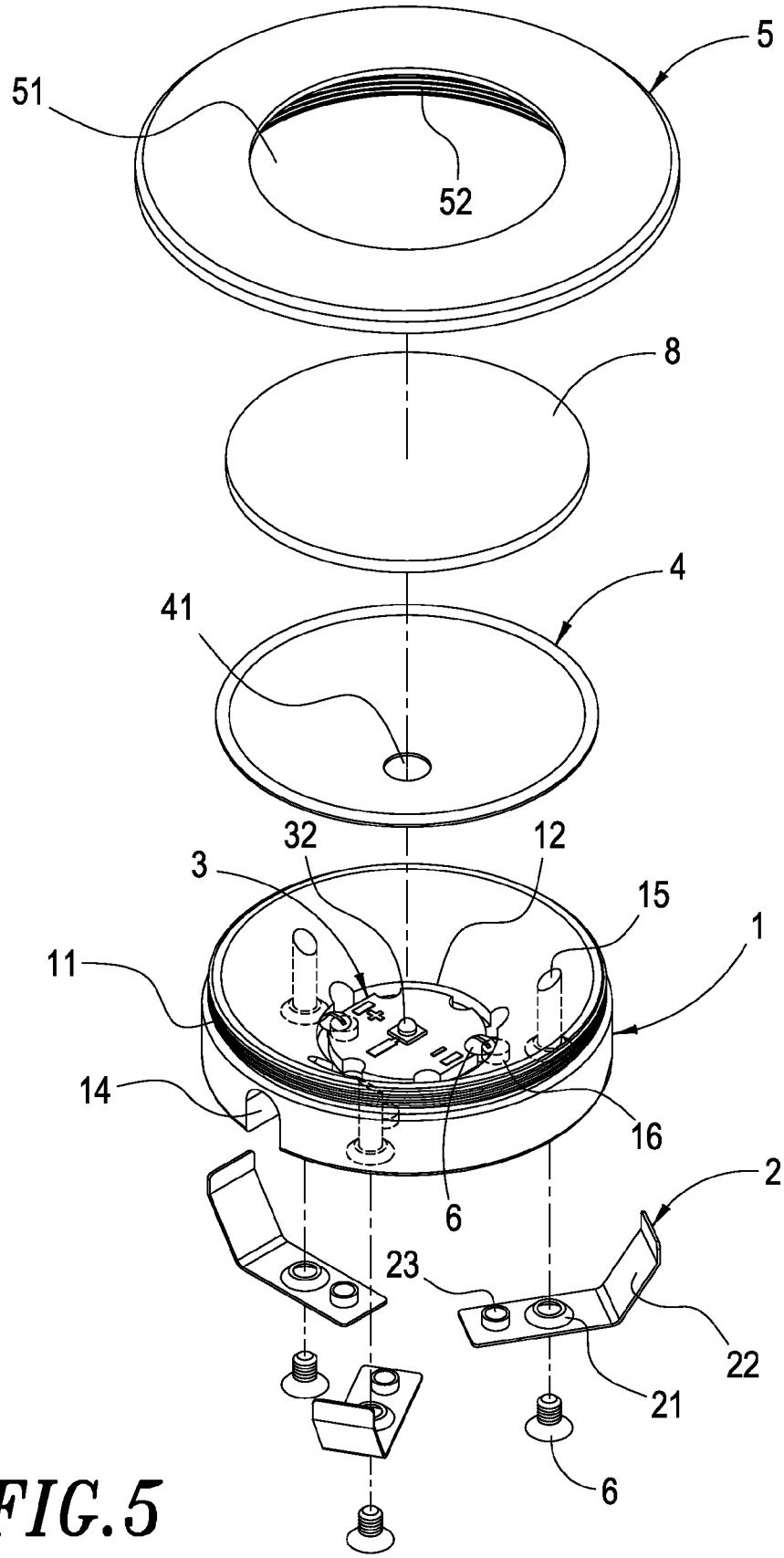
FIG. 5 is an exploded view showing the second embodiment of the present invention.

Please see FIGS. 5 and 6, which illustrate a second embodiment of the present invention. The differences between the second embodiment and the first embodiment are that, in the latter, at least one positioning hole 16 is additionally provided in the bottom of the main body 1 and a vertical positioning portion 23 is additionally provided on each flexible strip 2.

Figure 7:
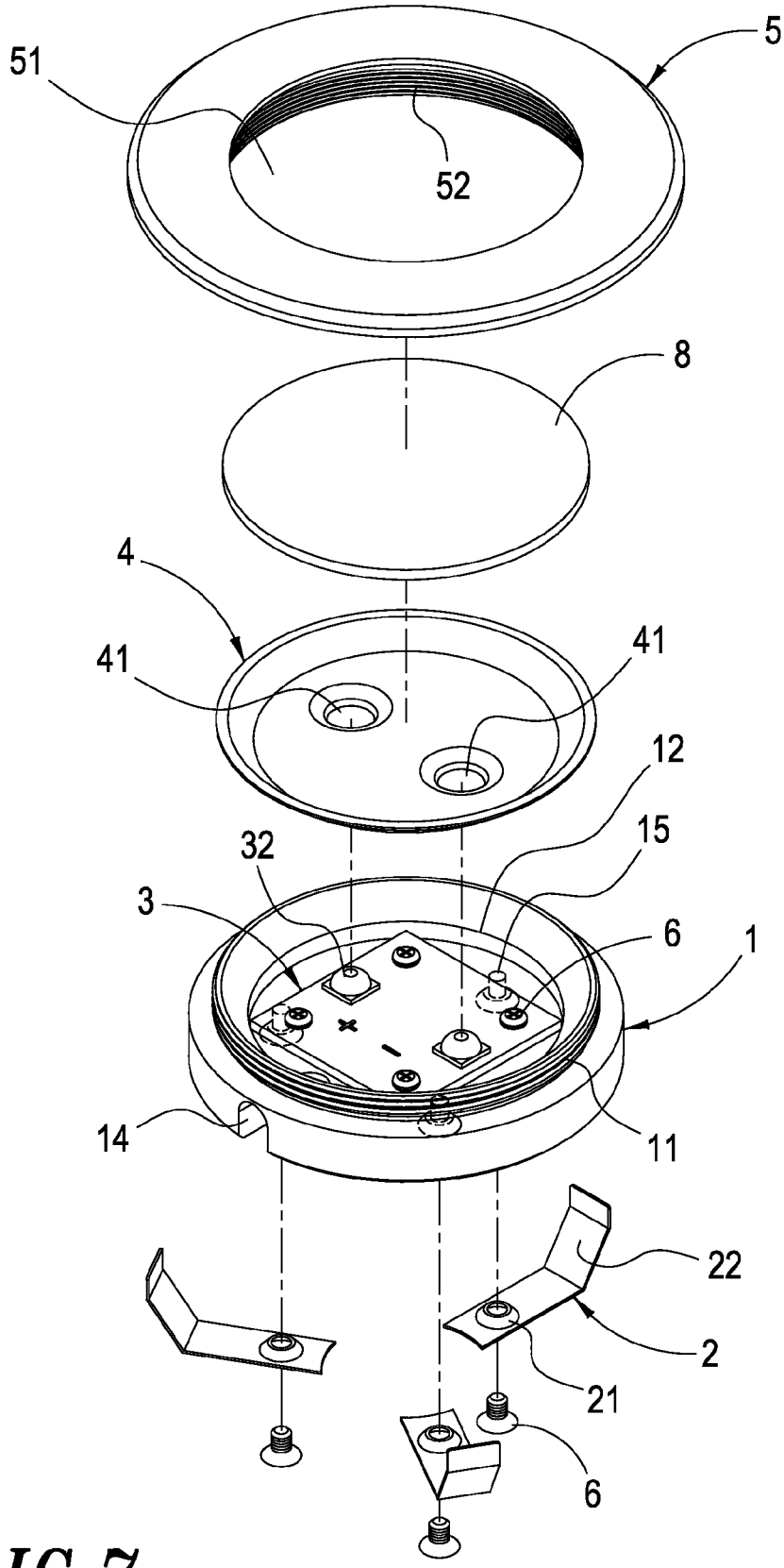
FIG. 7 is an exploded view showing the third embodiment of the present invention.
Figure 8:
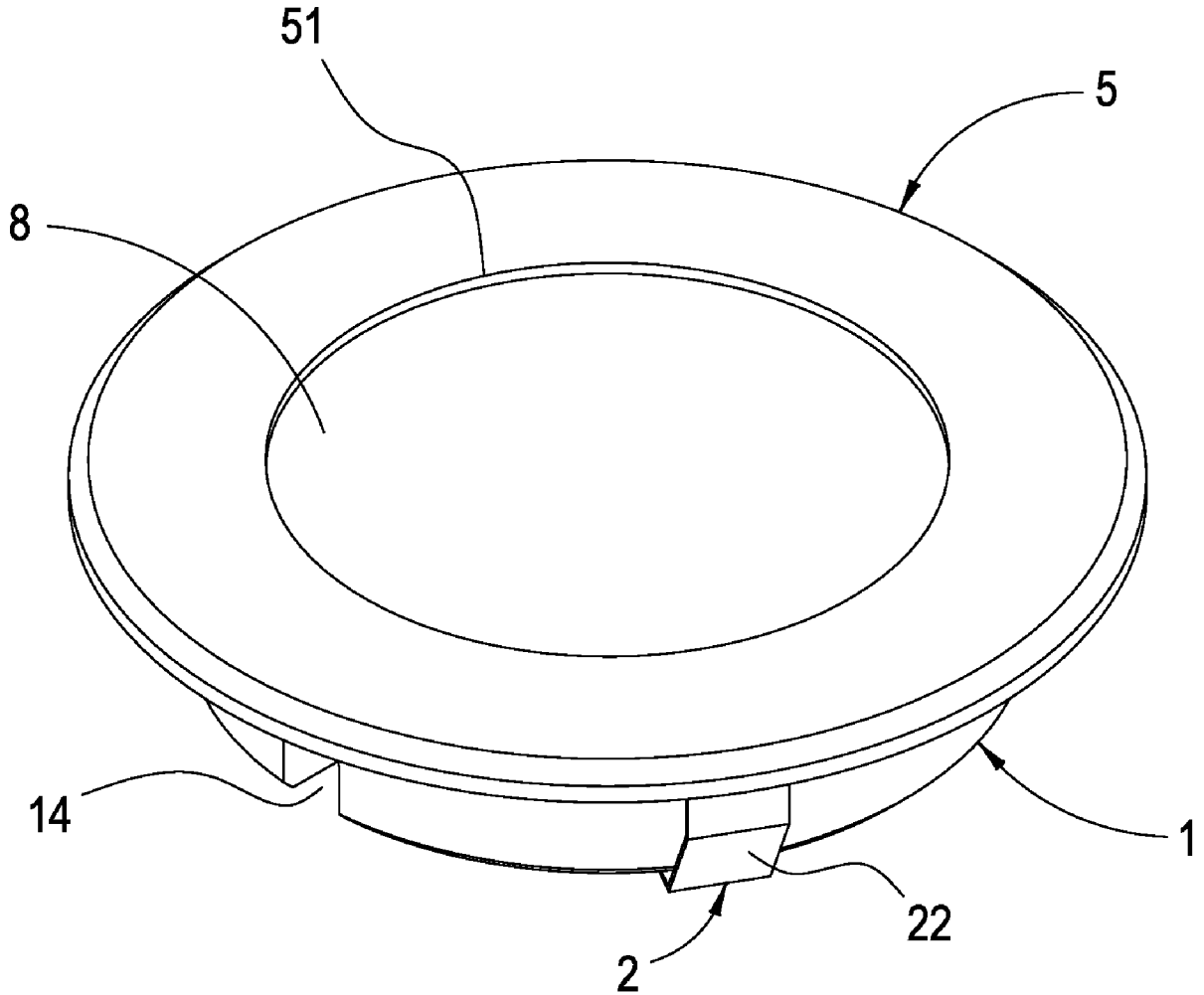
FIG. 8 is another view showing the third embodiment of the present invention in an assembled condition.

Please refer to FIGS. 7 and 8, which illustrate a third embodiment of the present invention. The differences between the third embodiment and the first embodiment are that, in the latter, the two slots 31 provided on two sides of the LED module 3 are modified into two threaded holes (the two holes may be lined up with the two holes 13 of the main body 1); two light emitting elements 32 are disposed on the LED module 3; two openings 41 are provided on the lower end of the light diverging unit 4 (and may be lined up with the two light emitting elements 32).

In comparison to the prior art, the LED light assembly of the present invention has the following advantages:

1. In the LED light assembly of the present invention, the LED module is fitted to a universal joint and a light diverging unit is fitted on top of the light emitting element. Therefore, a user can control the direction of the light and the light may be evenly distributed by the light diverging unit.

2. Because almost all the components of the assembly of the present invention are made of metal, heat generated by the LED module may be dissipated quickly and hence the assembly of the present invention may have a longer service life.

3. The flexible strips allow the assembly of the present invention to be installed in any place with a recess or a hole.

4. The assembly of the present invention is structurally simple and easy to use and may be installed quickly.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An LED light assembly, comprising:

a main body, having a centrally provided through opening, wherein a circular slot is provided near an upper rim of the main body and two holes are provided in the slot, and wherein an electric line slot and at least a positioning hole are provided in the bottom of the main body and the electric line slot is in communication with the opening;

at least one flexible strip, wherein two positioning holes are disposed on each flexible strip and may be aligned with the positioning holes of the main body, and wherein a guiding portion that extends upwards is provided on either side of each flexible strip and the flexible strips are fitted to the bottom of the main body, and wherein in assembly, first the two positioning holes of each flexible strip are lined up with the positioning holes of the main body and then fasteners are used to fixedly connect them together;

an LED module, wherein a light emitting element is disposed on the LED module and is fitted to the circular slot of the main body;

a light diverging unit, wherein an opening is provided on the lower end of the light diverging unit and may be lined up with the light emitting element, and wherein the light diverging unit is fitted on top of the light emitting element;

a light transmitting piece, disposed on top of the light diverging unit; and a top cover, wherein a through opening is provided in the top cover and the top cover is fitted to the upper end of the main body.

2. The LED light assembly as in claim 1, wherein a male thread is provided on the outer surface of the main body and a female thread is provided in the inner wall of the opening of the top cover, and wherein the male thread of the main body fixedly engages with the female thread of the top cover.

3. The LED light assembly as in claim 1, wherein a male thread is provided on the outer surface of the main body and a female thread is provided near the lower end of the top cover, and wherein the male thread of the main body fixedly engages with the female thread of the top cover.

4. The LED light assembly as in claim 1, wherein a slot is provided on either side of the LED module and the two slots are lined up with the two holes of the main body, and wherein, in assembly, first the two slots are lined up with the two holes of the main body and fasteners are used to fixedly connect them together.

5. The LED light assembly as in claim 1, wherein a circular protrusion, which extends from the rim of the opening, is provided and can limit the movement of the light diverging unit by pushing against the upper end of the light diverging unit.

* * * * *